US011325184B2

(12) United States Patent
Heckendorn et al.

(10) Patent No.: US 11,325,184 B2
(45) Date of Patent: May 10, 2022

(54) METHOD FOR PRODUCING A POWDER-METALLURGICAL PRODUCT

(71) Applicant: MAHLE International GmbH, Stuttgart (DE)

(72) Inventors: Heiko Heckendorn, Schopfheim (DE); Lilia Kurmanaeva, Schopfheim (DE); Patrick Sutter, Schopfheim (DE); Klaus Wintrich, Schopfheim (DE)

(73) Assignee: MAHLE International GmbH, Stuttgart (DE)

( * ) Notice: Subject to any disclaimer, the term of this patent is extended or adjusted under 35 U.S.C. 154(b) by 151 days.

(21) Appl. No.: 16/548,081

(22) Filed: Aug. 22, 2019

(65) Prior Publication Data

US 2020/0061703 A1 Feb. 27, 2020

(30) Foreign Application Priority Data

Aug. 24, 2018 (DE) ..... 10 2018 214 344.7

(51) Int. Cl.
*B22F 1/148* (2022.01)
*B22F 3/10* (2006.01)
*B22F 1/10* (2022.01)

(52) U.S. Cl.
CPC ..... *B22F 1/148* (2022.01); *B22F 1/10* (2022.01); *B22F 3/1021* (2013.01); *B22F 2301/35* (2013.01); *B22F 2998/10* (2013.01)

(58) Field of Classification Search
CPC .... B22F 1/0096; B22F 1/0059; B22F 3/1021; B22F 2301/35; B22F 2998/10
See application file for complete search history.

(56) References Cited

U.S. PATENT DOCUMENTS 7,192,464 B2 3/2007 Hammond
2003/0177866 A1 9/2003 Veloff et al.
2009/0252634 A1* 10/2009 Scholl ..... C22C 33/0257 419/1

FOREIGN PATENT DOCUMENTS

DE 102013210895 A1 12/2014
KR 20020008094 A * 1/2002

OTHER PUBLICATIONS

Halloran ("Role of powder agglomerates in ceramic processing." Forming of Ceramics. Advances in Ceramics. 9 (1983): 67.) (Year: 1983).*
KR-20020008094-A english translation (Year: 2002).*

* cited by examiner

*Primary Examiner* — Anthony J Zimmer
*Assistant Examiner* — Ricardo D Morales
(74) *Attorney, Agent, or Firm* — Falk Ewers; Ewers IP Law PLLC

(57) ABSTRACT

A method for producing a powder-metallurgical product, in particular a bearing element or a motor component, is provided. According to the method, a metal powder, typically with a grain size between 2 μm and 15 μm, is melt-metallurgically produced and agglomerated into a powder mixture having a grain size smaller than 400 μm by organic binders and waxes. Subsequently, the agglomerated powder mixture is formed into a green body typically by way of uniaxial pressing and the formed green body thermally debindered. Finally, the debindered green body is sintered typically at temperatures of 1000° C. to 1300° C. and the sintered body reworked into the powder-metallurgical product.

8 Claims, 1 Drawing Sheet

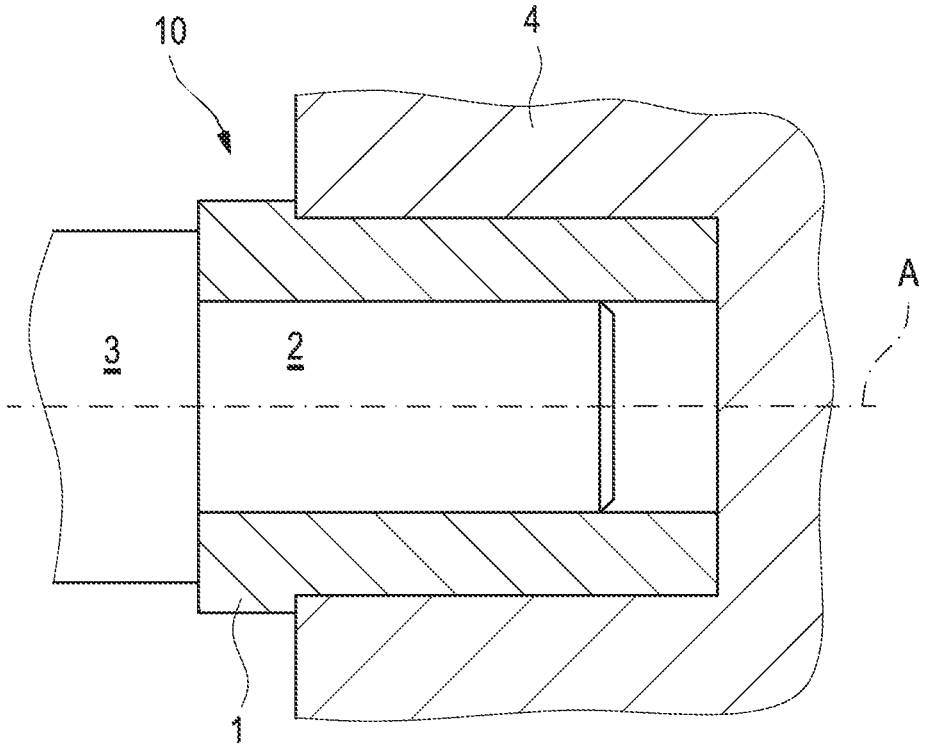
10
4
A
3
2
1

METHOD FOR PRODUCING A POWDER-METALLURGICAL PRODUCT

CROSS REFERENCE TO RELATED APPLICATIONS

This application claims priority to German patent application DE 10 2018 214 344.7, filed Aug. 24, 2019, the entire content of which is incorporated herein by reference.

TECHNICAL FIELD

The invention relates to a method for producing a powder-metallurgical product, in particular a bearing element or a motor component, and to a powder-metallurgical product which is produced by carrying out this method. The invention, furthermore, relates to a tribological system having such a powder-metallurgical product and to an internal combustion engine and to an electric machine each having such a powder-metallurgical product and, alternatively or additionally, such a tribological system.

BACKGROUND

It is known to produce bearing elements and motor components powder-metallurgically. Such powder-metallurgical production methods make possible a highly precise manufacture which requires only few reworking steps. At the same time, constituent parts, such as for example lubricants and slip additives, which can otherwise be admixed only with difficulty, can be easily added powder-metallurgically.

Such conventional methods, valve seat rings or bearing elements are produced for example from a ferritic cast material. However, relatively large carbides develop in the ferritic structure of the product in the process and the creep and wear resistance of the product is frequently inadequate. When using Martensitic cast materials or conventional sintering methods by contrast, no high corrosion resistance of the product is ensured, in particular in the case that a liquid sintering method was employed. In the case of bearing elements produced by such sintering methods, a "swelling-up" of the product through a low heat resistance frequently occurs, which can result in a shaft falling out of or seizing up in the bearing element. The latter disadvantage materializes also when using austenitic materials.

SUMMARY

It is an object of the present invention to provide an improved production method for powder-metallurgical products, in particular for bearing elements, and motor components. In particular, powder-metallurgical products with improved creep, heat, corrosion, and wear resistance are to be produced by such a method so that the created powder-metallurgical products also have an increased lifespan and an increased accuracy of fit when they are employed in an internal combustion engine or electric power machine.

According to the invention, this object is solved through the subject of the independent patent claims. Advantageous embodiments are subject of the dependent patent claims.

The invention relates to a method for producing a powder-metallurgical product, in particular a bearing element or a motor component. According to the method, a metal powder with a mean granulate size between 2 μm and 15 μm is melt-metallurgically produced and agglomerated into a powder mixture, typically with a mean granulate size of less than 400 μm by organic binders and waxes. Subsequently, the agglomerated powder mixture is formed into a green body typically by way of uniaxial pressing and the formed green body thermally debindered. Finally, the debindered green body is typically sintered at temperatures of 1000° C. to 1300° C., and the sintered green body reworked into the powder-metallurgical product.

According to an exemplary embodiment of the method, the produced metal powder is based on iron and, alternatively or additionally, contains more than 20% by weight of chromium and more than 1% by weight of carbon.

According to a further exemplary embodiment of the method, the metal powders with proportions in each case are smaller than or equal to 5% by weight and alternatively or additionally, solid lubricants and, alternatively or additionally, hard phases and, alternatively or additionally, further metal powders on iron bases are admixed to the metal powder during the agglomeration.

Typically, the agglomerated powder mixture contains 1 to 2.8% by weight of carbon, 20 to 39% by weight of chromium, 0.1 to 1.8% by weight of manganese, 0 to 4% by weight of nickel, 0.5 to 5% by weight of molybdenum, 0.5 to 3.5% by weight of silicon and 0 to 3.5% by weight of vanadium, cobalt, copper, tungsten and niobium each. By this exemplary embodiment, the creep, heat, corrosion and wear resistance of a powder-metallurgical product produced by the product according to the invention can be even further optimized.

Particularly practically, the agglomerated powder mixture is formed into a green body in particular by way of uniaxial pressing with a pressure of 400 MPa to 1,500 MPa. This proves to be particularly advantageous for a further processing and likewise for a powder-metallurgical product produced by the method according to the invention.

Likewise particularly practically, the formed green body is debindered at temperatures of 45° C. to 820° C. This likewise proves to be particularly advantageous for a further processing and for a powder-metallurgical product produced by the method according to the invention.

Particularly advantageously, the debindered green body is sintered at a temperature between 1115° C. and 1275° C.

Practically, the metal powder is produced by water atomization.

Likewise practically, the metal powder is agglomerated by spray drying.

The invention, furthermore, relates to a powder-metallurgical product which is produced by the method according to the invention. The advantages of the method according to the invention explained above therefore apply also to the powder powder-metallurgical product according to the invention.

Typically, the powder-metallurgical product has, for a predominant part, a ferritic structure.

According to an exemplary embodiment of the powder-metallurgical product according to the invention, the powder-metallurgical product according to the invention contains 1 to 2.8% by weight of carbon, 20 to 39% by weight of chromium, 0.1 to 1.8% by weight of manganese, 0 to 4% by weight of nickel, 0.5 to 5% by weight of molybdenum, 0.5 to 3.5% by weight of silicon and 0 to 3.5% by weight each of vanadium, tungsten, cobalt, niobium, copper and production-related contaminations.

According to a further exemplary embodiment of the powder-metallurgical product according to the invention, the powder-metallurgical product according to the invention contains 1.8 to 2.5% by weight of carbon, 29 to 36% by weight of chromium, 0.2 to 1.2% by weight of manganese, 0 to 1% by weight of nickel, 1 to 5% by weight of molybdenum, 0.8 to 3.5% by weight of silicon and production-related contaminations.

According to an exemplary embodiment, the powder-metallurgical product has a relative density of greater than 94%. It was possible to show that in this way significantly improved creep and wear properties of a powder-metallurgical product produced by the method according to the invention can be achieved.

According to a further exemplary embodiment, the carbides in the ferritic structure of the powder-metallurgical product have a size of less than 50 It was possible to show that significantly improved creep and wear properties of a powder-metallurgical product produced by the method according to the invention can also be achieved in this way.

The invention, furthermore, relates to a tribological system which comprises a powder-metallurgical product introduced above. The advantages of the method according to the invention and of the powder-metallurgical product according to the invention explained above thus apply also to the tribological system according to the invention.

According to an exemplary embodiment of the tribological system according to the invention, the surface of the powder-metallurgical product according to the invention is in mechanical contact with a product which contains 0 to 0.1% by weight of carbon, 0 to 0.5% by weight of silicon, 0 to 0.5% by weight of manganese, 0 to 0.015% by weight each of phosphorous and sulphur, 13.5 to 15.5% by weight of chromium, 30 to 33.5% by weight of nickel, 0.4 to 1.4% by weight of molybdenum, 1.6 to 2.2% by weight of aluminum, 2.3 to 2.9% by weight of titanium, 0.4 to 1% by weigh of niobium and the remaining proportion of the total weight is formed by iron and production-related contaminations.

The invention, furthermore, relates to an internal combustion engine for a motor vehicle. The internal combustion engine comprises a powder-metallurgical product introduced above and, alternatively or additionally, a tribological system introduced above. The advantages of the method according to the invention, of the powder-metallurgical product according to the invention and of the tribological system according to the invention explained above therefore apply also to the internal combustion engine according to the invention.

The invention, furthermore, relates to an electric power machine for a motor vehicle. The electric power machine comprises a powder-metallurgical product introduced above and, alternatively or additionally, a tribological system introduced above. The advantages of the method according to the invention, of the powder-metallurgical product according to the invention and of the tribological system according to the invention explained above therefore apply also to the electric power machine according to the invention.

Further important features and advantages of the invention are obtained from the subclaims, from the drawing and from the associated FIGURE description by way of the drawing.

It is to be understood that the features mentioned above and still to be explained in the following cannot only be used in the respective combination stated but also in other combination stated but also in other combinations or by themselves without leaving the scope of the present invention.

BRIEF DESCRIPTION OF THE DRAWINGS

The invention will now be described with reference to the drawings wherein:

FIG. 1 shows a schematic illustration of a tribological system according to an exemplary embodiment of the invention.

DESCRIPTION OF EXEMPLARY EMBODIMENTS

An exemplary embodiment of the invention is shown in FIG. 1 and is explained in more detail in the following description.

FIG. 1 illustrates a simplified example of a tribological system 10 according to the invention, which is used in an internal combustion engine of a motor vehicle or an electric power machine of a motor vehicle. The tribological system 10 comprises a bearing element 1 which is arranged in a bearing housing 4, a shaft 3 and a shaft journal 2 connected to a shaft 3. In the tribological system 10, friction is created between the bearing element 1 and the shaft journal 2 and, alternatively or additionally, between the bearing element 1 and the shaft 3 because the shaft journal 2 together with the shaft 3 rotates relative to the bearing element 1 about an axis A.

Apart from this, the surface of the bearing element 1 can be in mechanical contact with a product which contains 0 to 0.1% by weight of carbon, 0 to 0.5% by weight of silicon, 0 to 0.5% by weight of manganese, 0 to 0.015% by weight of phosphorous and sulphur each, 13.5 to 15.5% by weight of chromium, 30 to 33.5% by weight of nickel, 0.4 to 1.4% by weight of molybdenum, 1.6 to 2.2% by weight of aluminium, 2.3 to 2.9% by weight of titanium, 0.4 to 1% by weight of niobium and the remaining proportion of the total weight is formed by iron and production-related contaminations.

The bearing element 1 can for a predominant part have a ferritic structure.

In addition, the bearing element 1 can additionally contain 2.8% by weight of carbon, 20 to 39% by weight of chromium, 0.1 to 1.8% by weight of manganese, 0 to 4% by weight of nickel, 0.5 to 5% by weight of molybdenum, 0.5 to 3.5% by weight of silicon, 0 to 3.5% by weight each of vanadium, tungsten, cobalt, niobium, copper as well as production-related contaminations.

The powder-metallurgical product can contain 1.8 to 2.5% by weight of carbon, 29 to 36% by weight of chromium, 0.2 to 1.2% by weight of manganese, 0 to 1% by weight of nickel, 1 to 5% by weight of molybdenum, 0.8 to 3.5% by weight of silicon as well as production-related contaminations.

The bearing element 1 can have a relative density of greater than 95% and, alternatively or additionally, the carbides in the ferritic structure of the bearing element 1 can have a size of less than 50 μm. Here, "relative density" means the ratio of the absolute density relative to the density of pure water in the standard state at 3.98° C.

The bearing element 1 was produced by the method according to the invention, i.e., powder-metallurgically.

In the method for producing the bearing element 1 according to the invention, a metal powder with a mean granulate size between 2 μm and 15 μm is melt-metallurgically produced and agglomerated into a powder mixture, typically with a mean granulate size of less than 400 μm, by organic binders and waxes. Mean granulate size as part of the present invention means the arithmetic mean of the granulate diameter of a quantity of powder granulates. The agglomerated powder mixture is formed into a green body preferentially by way of uniaxial pressing. The formed green body is subsequently thermally debindered to remove the organic binders and waxes and the debindered green body is then sintered typically at temperatures between 1000° C. and 1300° C. Here, sintering can take place in the vacuum or in a nitrogen-hydrogen atmosphere. Finally, the sintered green body is reworked into the bearing element.

Here, the produced metal powder can be based on iron and, alternatively or additionally, contain more than 20% by weight of chromium and more than 1% by weight of carbon.

Apart from this, further metal powders with proportions in each case smaller than or equal to 5% by weight and, alternatively or additionally, solid lubricants and, alternatively or additionally, hard phases and, alternatively or additionally, further metal powders on iron bases can be admixed during the agglomeration of the powder mixture.

The agglomerated powder mixture can contain 1 to 2.8% by weight of carbon, 20 to 39% by weight of chromium, 0.1 to 1.8% by weight of manganese, 0 to 4% by weight of nickel, 0.5 to 5% by weight of molybdenum, 0.5 to 3.5% by weight of silicon and 0 to 3.5% by weight each of vanadium, cobalt, copper, tungsten, and niobium.

In addition to this, the agglomerated powder mixture can be formed into a green body with a pressure of 400 MPa to 1,500 MPa.

Furthermore, the formed green body can be debindered at temperatures of 45° C. to 820° C. The debindered green body in turn can be sintered at a temperature between 1115° C. and 1275° C.

The metal powder can be produced by water atomization and, alternatively or additionally, agglomerated by spray drying.

In the manner shown above, other powder-metallurgical products in particular sealing or sliding elements, valve drive and turbocharger components, valve components, valve guides, bearing bushes, camshafts, running and guide bushes, shaft sealing rings, valve bodies, valve seat rings or components in emission control or exhaust gas recirculation systems can likewise be produced.

What is claimed is:

1. A method for producing a powder-metallurgical product comprising the steps of:

a) melt-metallurgical producing a metal powder with a mean granulate size between 2 μm and 15 μm;

b) agglomerating the metal powder produced in step a) by organic binders and waxes into a powder mixture containing 1 to 1.4% by weight of carbon, 27 to 39% by weight of chromium, 0.1 to 0.5% by weight of manganese, 3.1 to 4.0% by weight of nickel, 2.6 to 5.0% by weight of molybdenum, 2.1 to 3.5% by weight of silicon, 2.1 to 3.5% by weight of tungsten, 2.1 to 3.5% by weight of vanadium, 0.1 to 3.5% by weight of copper, and 0.0 to 3.5% by weight each of cobalt and niobium, with the mean granulate size of less than 400 μm;

c) forming the powder mixture agglomerated in step b) into a green body by uniaxial pressing;

d) thermal debindering the green body formed in step c);

e) sintering the green body debindered in step d) at temperatures of 1000° C. to 1300° C.; and f) reworking the green body sintered in step e) into the powder-metallurgical product.

2. The method according to claim 1, wherein the metal powder produced in step a) is iron based and/or contains more than 20% by weight of chromium and more than 1% by weight of carbon.

3. The method according to claim 1, further comprising: in step b) admixing further metal powders with proportions smaller than or equal to 5% each and/or solid lubricants and/or hard phases and/or further metal powders on iron base.

4. The method according to claim 1, further comprising: in step c), forming the powder mixture agglomerated in step b) into the green body under a pressure of 400 MPa to 1500 MPa.

5. The method according to claim 1, further comprising: in step d), debindering the green body formed in step c) at temperatures from 45° C. to 820° C.

6. The method according to claim 1, further comprising: in step e), sintering the green body debindered in step d) at a temperature between 1115° C. and 1275° C.

7. The method according to claim 1, further comprising: in step a), producing the metal powder by water atomization.

8. The method according to claim 1, further comprising: in step b), agglomerating the metal powder by spray drying.

* * * * *